US008336998B2

(12) United States Patent
Kuwata et al.

(10) Patent No.: US 8,336,998 B2
(45) Date of Patent: Dec. 25, 2012

(54) IMAGE FORMING APPARATUS

(75) Inventors: Masahiro Kuwata, Atsugi (JP); Tadashi Hayakawa, Kanagawa Prefecture (JP); Ikoh Soh, Atsugi (JP); Toshiroh Tokuno, Machida (JP); Tomomi Katoh, Ebina (JP); Akiko Bannai, Atsugi (JP); Shotaro Takeuchi, Atsugi (JP); Masanori Kusunoki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 344 days.

(21) Appl. No.: 12/839,830

(22) Filed: Jul. 20, 2010

(65) Prior Publication Data

US 2011/0025789 A1 Feb. 3, 2011

(30) Foreign Application Priority Data

Jul. 30, 2009 (JP) ..... 2009-177475

(51) Int. Cl.
*B41J 2/175* (2006.01)

(52) U.S. Cl. ..... 347/85

(58) Field of Classification Search ..... 347/66, 347/84, 85, 86
See application file for complete search history.

(56) References Cited

U.S. PATENT DOCUMENTS

| | | | | |
|---|---|---|---|---|
| 4,476,472 | A * | 10/1984 | Aiba et al. | 347/86 |
| 5,561,448 | A * | 10/1996 | Kaneko et al. | 347/29 |
| 6,443,560 | B1 * | 9/2002 | Okano et al. | 347/55 |
| 7,901,063 | B2 * | 3/2011 | Wouters et al. | 347/89 |
| 8,007,084 | B2 * | 8/2011 | Kobayashi et al. | 347/85 |
| 8,047,640 | B2 * | 11/2011 | Uchiyama et al. | 347/85 |

FOREIGN PATENT DOCUMENTS

| | | |
|---|---|---|
| JP | 4-214360 | 8/1992 |
| JP | 2006-281588 | 10/2006 |
| JP | 4151939 | 7/2008 |
| JP | 2008-213392 | 9/2008 |

* cited by examiner

*Primary Examiner* — Anh T. N. Vo
(74) *Attorney, Agent, or Firm* — Cooper & Dunham LLP

(57) ABSTRACT

A liquid discharging-type image forming apparatus capable of securely eliminating mixed air bubbles from the ink liquid and forming a stable image. The apparatus includes: a sub tank 35 of which negative pressure amount is detected; a pump 115 sucking ink when the detected amount of the sub tank 35 is lower than a predetermined amount so that the sub tank 35 and recording heads 34 have negative pressure; a second backflow prevention unit 203 to stop the sent ink to be reserved in a second liquid container 201, which is pressurized as ink increases. When the ink is again filled in the sub tank 35, the ink is sent from the second liquid container 201 before being sent from the first liquid container. Accordingly, ink is not accumulated in the second liquid container 201, allowing the second liquid container 201 to be smaller and the image forming apparatus as a whole to be more compact.

18 Claims, 10 Drawing Sheets

IMAGE FORMING APPARATUS

CROSS-REFERENCE TO RELATED APPLICATIONS

The present application claims priority from Japanese patent application number 2009-177475, filed on Jul. 30, 2009, the entire contents of which are hereby incorporated by reference herein.

BACKGROUND OF THE INVENTION

1. Field of the Invention

The present invention relates to an image forming apparatus, and more particularly to an image forming apparatus forming an image by discharging droplets.

2. Discussion of the Related Art

An image forming apparatus such as a printer, a facsimile machine, or a multifunctional apparatus including the above functions further includes an inkjet-type image forming apparatus. The inkjet-type image forming apparatus includes a droplet discharging device including a recording head. The recording head is formed of a liquid discharging head, which discharges droplets of recording liquid (or ink) to be attached to a recording medium while conveying the recording medium, thereby forming images thereon. It is to be noted that terms such as recording, printing, print, and the like may also be used for image formation.

A well-known image forming apparatus including a liquid discharging device is in general configured as follows. A small capacity liquid container or a head tank (which may also be called a sub tank) which supplies liquid (hereinafter, to be referred to as ink) to the recording head on a carriage is provided. The image forming apparatus includes a main cartridge or a main tank in the apparatus body side and ink is supplied from the main cartridge of the apparatus body side to the head tank, or otherwise, an ink cartridge, a replaceable liquid container, is provided together with the recording head.

The image forming apparatus including a commonly used head tank has an ink supply path, to supply ink from the main tank to the head tank, formed of in many cases a flexible resinous tube whose precise configuration and dimensions are determined by the layout, ease of assembly, and ease of maintenance. If negative pressure generation means is to be provided inside the head tank, a flexible film is used for that means in many cases. The tube and film, however, are susceptible to being penetrated by air from outside gradually, and inevitably air gets into the head tank. Further, the air present in the main tank, mixed-in air in the supply path at a time of attachment/detachment of the main tank, and the air dissolved in the ink finally accumulate inside the head tank via the ink supply path.

To cope with the above problem, JP-2008-213392-A discloses a technique to securely discharge mixed-in air from an air discharging means provided to the sub tank. Specifically, a liquid moving means capable of sending ink to the sub tank which supplies ink from the main tank to the liquid discharging head and capable of returning ink from the sub tank to the main tank is provided. Due to this recycling of, the ink is not wasted and the mixed-in air may be securely discharged from an air discharging means provided to the sub tank.

The same also discloses that a recording head is disposed such that a nozzle to discharge ink faces the recording target and thus, the recording head needs to keep negative pressure so that the nozzle which is not expected to discharge ink does not leak any ink. As a means to keep the recording head negatively pressurized, there is a method to generate negative pressure by providing the recording head and the ink cartridge at positions having a positional difference in height from each other using the resultant water head difference.

In addition, Japanese Patent No. 4151939 (JP-4151939-B) discloses a technique to generate negative pressure inside the liquid container, in which a liquid container formed of a flexible member and a member biasing the liquid container toward outside are arranged; the volume of the space inside the liquid container is reduced by a pressurizing means and the liquid is supplied from an ink cartridge to the liquid container; and then, the biasing pressure by the biasing means is released and the negative pressure is formed inside the liquid container.

There is also another technique to generate negative pressure, in which a sub tank is formed of a flexible member and a member to press the sub tank toward outside, and a liquid moving means provided in the liquid supply path between a main tank and the above sub tank returns the ink from the sub tank to the main tank, thereby forming negative pressure.

The image forming apparatus of a general inkjet method employs ink as a consumable product, and in many cases, for ease of the replacement, employs a replaceable cartridge-type ink tank which can be attached to the inkjet recording apparatus. This cartridge-type ink tank (hereinafter "ink cartridge") is replaced with a new ink cartridge if the ink therein is consumed and the ink cartridge becomes empty.

There are four colors of ink, yellow (Y), magenta (M), cyan (C) and black (K). Even though the general name of the color is the same, various types are available depending on the usage such as for photographic image printing, text printing, and the like. If another type of ink is to be used depending on the purpose, the current ink cartridge which is not empty is detached from the apparatus in the middle of the operation and another type of ink cartridge is attached for usage. This replacement work is repeatedly performed.

JP-H04-214360-A and JP-2006-281588-A disclose a type of ink cartridge in which the ink is contained in a small bag member having low air permeability for shielding the ink from outside air to prevent modification of quality of the ink, and this bag member is contained in a casing.

This bag-like ink cartridge includes an ink outlet through which ink is supplied to the recording head. This ink outlet is formed, for example, of a rubber seal. An ink supply needle provided to the inkjet recording device is penetrated through the rubber seal, thereby forming a penetration opening to reach an inside of the ink bag.

The ink inside the ink bag is sucked toward the ink supply needle due to a sucking force generated by the recording head. As the ink is sucked and sent to the recording head, the ink bag is depressurized corresponding to the consumed amount of ink and has negative pressure relative to the atmospheric pressure. Accordingly, if the ink cartridge is removed from the inkjet recording device at this moment, upon the ink supply needle is extracted from the penetration opening, outside air or dusts flow into the ink bag through the penetration opening. Moreover, the ink cartridge in the middle of the operation has a reduced amount of ink and therefore has a small size. Accordingly, the ink bag is not stable inside the casing during the replacement operation and the pressure inside the ink bag is turbulent, which may raise a risk that the outside air or the dusts flow into the ink bag. The mixing of the air and dust with the ink may cause a defective ink discharge of the recording head.

As aforementioned, mixing of air into the sub tank, the recording head, and the liquid supply path, and mixing of the outside air and dust into the ink cartridge both cause defective image formation. In order to prevent both from happening, the technique disclosed by JP-2008-213392, that is, a configuration to perform ink supply and return between the main tank and the sub tank (a liquid moving means), and the technique disclosed by Japanese Patent No. 4151939, that is, a configuration to use a backflow prevention valve for preventing outside air and dust from flowing into the ink cartridge, may be collaterally applied to construct an apparatus. However, the combined use of these techniques has a problem in that, when the liquid moving means returns the ink from the sub tank to the main tank, the backflow prevention valve operates and prevents the ink from returning from the sub tank to the main tank. Accordingly, a satisfactory amount of ink may not be returned from the sub tank to the main tank, and therefore, there may be a case in which the air bubbles are not extracted satisfactorily from the sub tank, the recording head and the liquid supply path.

There is also such an adverse effect that even though a part of the liquid supply path is shielded by the backflow prevention valve, when the liquid moving means sends a liquid from the sub tank to the main tank, the pressure of the liquid in the liquid supply path rises abnormally, resulting in a leak of the ink from joint parts of the liquid supply path or the smearing of the components inside the image forming apparatus, the ink cartridge, and the like with ink. In the worst case, the joint parts of the liquid supply path are broken and the ink leaks continuously while sending ink from the first liquid container to the second liquid container.

JP-H04-214360-A discloses an ink cartridge provided with a ball-shaped backflow prevention valve and a reverse flow method in which air is sent when performing a recording head dischargeability recovery operation so that defective discharge generating factors such as air bubbles, dusts and agglomerated ink remaining around the head common liquid chamber are discharged. The same also discloses that the reverse flow is received by the sub tank, but does not disclose a backflow prevention valve provided at the side of the image forming apparatus body, a buffer tank of the cartridge side, nor a normal close valve.

Because of these reasons, a need exists for an image forming apparatus capable of solving the aforementioned conventional problems.

SUMMARY OF THE INVENTION

Accordingly, the present invention provides a novel image forming apparatus in which a first backflow prevention means securely prevents outside air or dust from entering into a first liquid container from a cartridge side engagement means.

The image forming apparatus may include a liquid moving means which once sends liquid containing air bubbles included in a recording head, a sub tank and a liquid supply path, to a second liquid container and again sends the ink to the sub tank and the recording head, thereby securely eliminating mixed-in air bubbles, and forming an image in a stable manner.

These and other objects, features and advantages of the present invention will become apparent upon consideration of the following description of the preferred embodiments of the present invention when taken in conjunction with the accompanying drawings.

DESCRIPTION OF THE PREFERRED EMBODIMENTS

Figure 1:
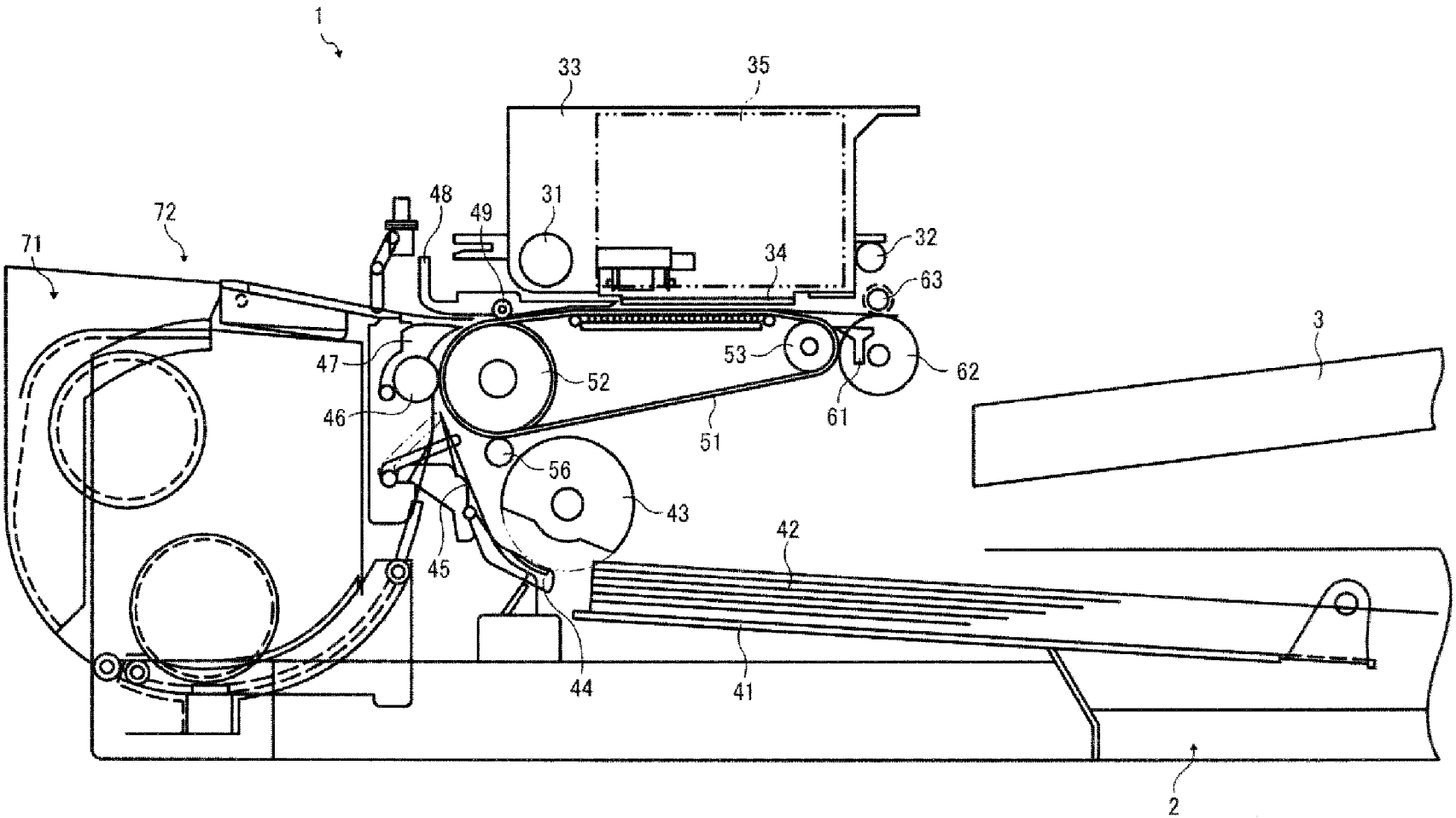
FIG. 1 is a schematic side view illustrating an entire configuration of a mechanical part of an image forming apparatus according to the present invention.

It is to be noted that terms such as "recording", "printing", "print", and the like may also be used for image formation "Image formation" means not only forming images with letters or figures having meaning to the medium but also forming images without meaning such as patterns to the medium. In addition, the term "image forming apparatus" means any device for forming an image by discharging droplets to media such as paper, thread, fiber, fabric, leather, metals, plastics, glass, wood, ceramics and the like. The liquid used to form the images is not limited to the recording liquid or ink, and not limited in particular as far as it may perform image formation. The term "liquid discharging device" means a device to discharge liquid from the liquid discharging head.

Generally, the present invention provides an image forming apparatus which forms an image by discharging droplets and includes a first backflow prevention means to prevent outside air and dusts from flowing from a cartridge side engagement means to a first liquid container. The present image forming apparatus further includes a liquid moving means which once sends liquid including air bubbles in a recording head, a sub tank and a liquid supply path, to a second liquid container and again sends the ink to the sub tank and the recording head, thereby securely eliminating mixed air bubbles. When negative pressure is to be generated in the recording head, the liquid moving means sends a liquid including air bubbles in the recoding head, sub tank and liquid supply path, to the second liquid container, thereby generating negative pressure to the recording head without wasting the ink. Further, even though the ink cartridge is detached from the apparatus body by the engagement means in a state in which the second liquid container is filled with liquid, the second backflow prevention means serves to prevent the ink liquid from flowing out from the second liquid container to the second engagement means of the recording apparatus body side. In particular, the second backflow prevention means serves to eliminate smears by the ink around the engagement means and prevents smears during the attachment/detachment operation of the engagement means, and the defective operation due to the increased viscosity of the residual ink.

Accordingly, the defective image formation occurring due to the defective ink discharge caused by the mixed air bubbles in the recording head, sub tank, and ink supply path and the resultant flows of air bubbles in the recording head may be prevented optimally and the stable image formation is enabled.

Having generally described this invention, further understanding can be obtained by reference to certain specific examples which are provided herein for the purpose of illustration only and are not intended to be limiting. In the descriptions in the following examples, the same reference numerals are given to identical parts having the same function.

An embodiment of the present invention will now be described with reference to the drawings.

Figure 2:
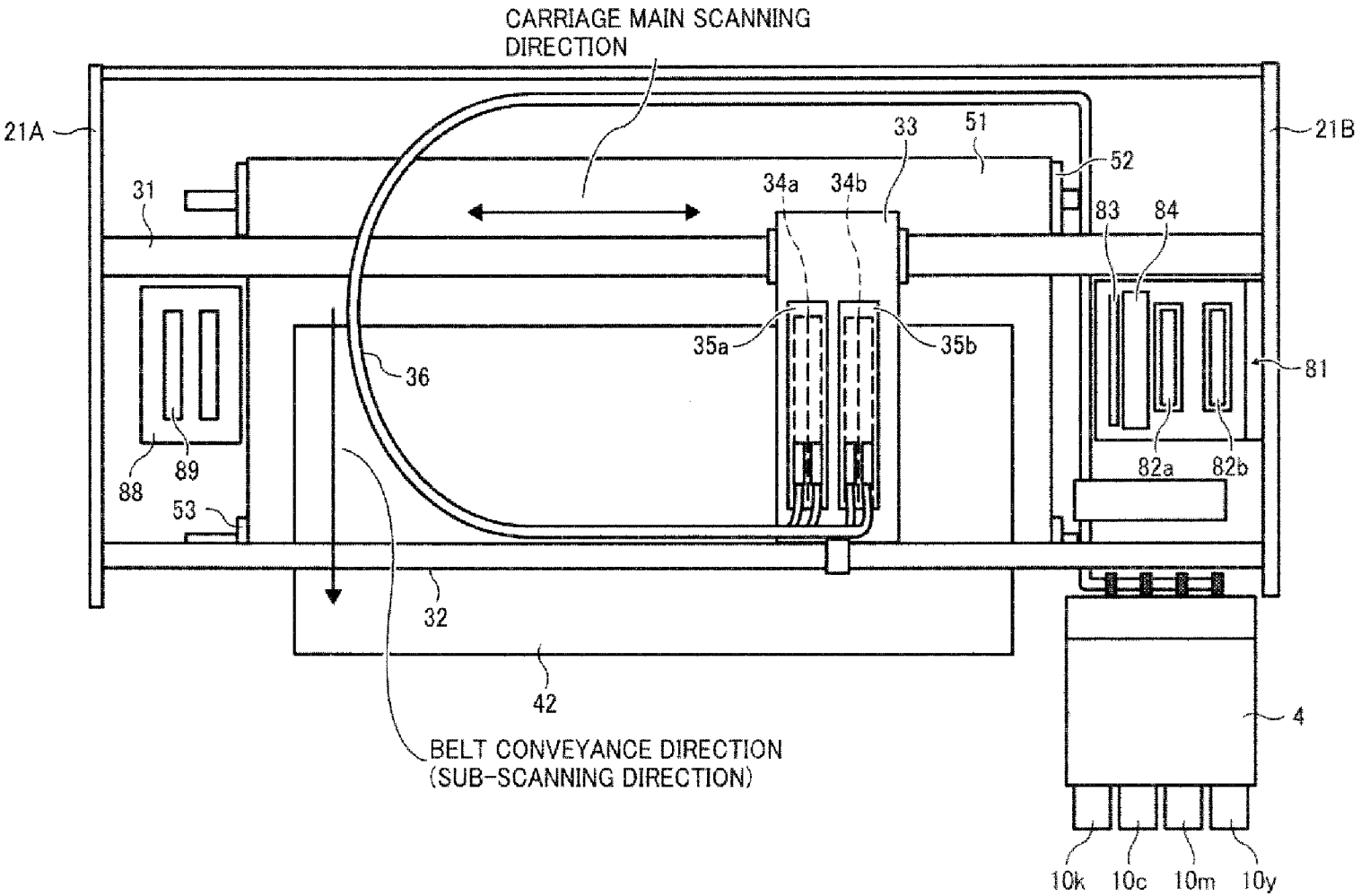
FIG. 2 is a plan view illustrating a main part of an image forming apparatus according to the present invention.

FIG. 1 is a schematic side view illustrating an entire configuration of an image forming apparatus of an embodiment of the present invention and FIG. 2 is a plan view illustrating a main part of the image forming apparatus.

This image forming apparatus is a serial-type image forming apparatus and includes: an apparatus body 1; right and left side plates 21A, 21B of the apparatus body 1; a main guide rod 31 and a sub guide rod 32, guide members, which are hanging on the right and left side plates 21A, 21B; and a carriage 33 slidably held by the main and sub guide rods 31, 32 in a main scanning direction and moving to scan in the direction shown by the two-way arrows (i.e., a carriage main scanning direction) in FIG. 2 via a timing belt driven by a main scanning motor, not shown.

Recording heads 34, mounted on the carriage 33, include divided recording heads 34*a*, 34*b*, which will be referred to as the recording heads 34 alternatively. The recording heads 34 are formed of liquid discharging heads according to the present invention to discharge ink droplets of respective colors of yellow(Y), cyan (C),magenta (M) and black (K) and include nozzle arrays formed of a plurality of nozzles arranged in a sub-scanning direction perpendicular to the main scanning direction, with the ink droplet discharging direction oriented downward.

The recording heads 34 each include two nozzle arrays. One of the nozzle arrays of the recording head 34*a* discharges droplets of black (K) and the other discharges droplets of cyan (C). One of the nozzle arrays of the recording head 34*b* discharges droplets of magenta (M) and the other discharges droplets of yellow (Y), respectively.

The carriage 33 includes sub tanks 35*a*, 35*b* (to be collectively referred to as sub tanks 35), a secondary liquid container, which supplies ink of respective colors corresponding to each of the nozzle arrays of the recording heads 34. The sub tanks 35 are used to supply ink of respective colors via a supply tube 36 for each color from ink cartridges 10*y*, 10*m*, 10*c* and 10*k* (to be referred to as ink cartridges 10 when any specific color is not indicated), a primary liquid container detachably mounted to a cartridge mount portion 4.

In the bottom of the image forming apparatus, there is provided a sheet feeding portion from which sheets 42 piled on a sheet piling portion (pressure plate) 41 of a sheet feed tray 2 are conveyed. The sheet feeding portion includes a semilunar roller (or a sheet feed roller) 43 to separate and feed sheets 42 from the sheet piling portion 41 one by one and a separation pad 44 facing the sheet feed roller 43 and formed of a material having a high friction coefficient. The separation pad 44 is pressed toward the side of the sheet feed roller 43.

Then, in order to send the sheet 42 fed from the sheet feed portion to the lower side of the recording head 34, a guide member 45 to guide the sheet 42, a counter roller 46, a conveyance guide member 47, a pressure member 48 including an end press roller 49, and a conveyance belt 51, a conveying means to electrostatically attract the fed sheet 42 and convey it at a position facing the recording heads 34.

This conveyance belt 51 is an endless belt stretching over a conveyance roller 52 and a tension roller 53 and is so configured as to rotate in a belt conveyance direction (i.e., a sub-scanning direction). In addition, a charging roller 56, which is a charging means to charge a surface of the conveyance belt 51, is provided. The charging roller 56 is provided to be in contact with the surface layer of the conveyance belt 51 and is driven to rotate accompanied by the rotation of the conveyance belt 51. The conveyance belt 51 is caused to rotate in a belt conveyance direction as shown in FIG. 2 by the rotation of the conveyance roller 52 driven by the sub-scanning motor, not shown.

Further, as a sheet ejection portion to eject the sheet 42 recorded by the recording heads 34, a separation claw 61 to separate a sheet 42 from the conveyance belt 51, a sheet discharge roller 62, and a spur 63 being a sheet discharge roller are provided. A sheet discharge tray 3 is provided underneath the sheet discharge roller 62.

A duplex unit 71 is provided detachably at a backside of the apparatus body 1. This duplex unit 71 pulls in a sheet 42 which has been returned by a reverse rotation of the conveyance belt 51, reverses the sheet 42, and feeds the reversed sheet 42 again in a portion between a counter roller 46 and the conveyance belt 51. An upper surface of the duplex unit 71 is used as a manual tray 72.

As illustrated in FIG. 2, a maintenance/recovery mechanism 81 including a recovery means to maintain conditions of the nozzles of the recording heads 34 and recover its conditions is provided at a non-print area at one side in the scanning direction of the carriage 33. This maintenance/recovery mechanism 81 includes: cap members 82*a*, 82*b*; a wiper blade 83; and a first dummy discharge receiver 84. The cap members 82*a*, 82*b* are provided to cap the nozzle surfaces of the recording heads 34 and are simply referred to as a cap 82 if it is not necessary to distinguish between the cap members. The wiper blade 83 is a blade member to wipe the nozzle surfaces. The dummy discharge receiver 84 receives droplets which are not used for the recording when performing a dummy discharge operation in order to discharge agglomerated recording liquid.

Further, as illustrated in FIG. 2, a second dummy discharge receiver 88 is provided at a non-print area at an opposite side in the scanning direction of the carriage 33 in order to receive droplets of recording liquid when performing a dummy discharge operation in which recording liquid having an increased viscosity during recording and not contributing to the recording is discharged. The second dummy discharge receiver 88 includes openings 89 aligned in the nozzle array direction.

In the thus configured image forming apparatus, the sheets 42 are separated and fed one by one from the sheet feed tray 2, the sheet 42 fed upward in substantially vertical direction is guided by the guide member 45, and is conveyed by being sandwiched between the conveyance belt 51 and the counter roller 46. The leading edge of the sheet 42 is then guided by the conveyance guide member 47 and is pressed against the conveyance belt 51 by the end press roller 49 to change the conveyance direction by 90 degrees.

Then, an alternate voltage, which is an alternate repetition of positive and negative voltages, is applied to the charge roller 56. Thus, the conveyance belt 51 is charged in an alternate charge pattern, in which a positive charge and a negative charge is alternately applied with predetermined widths in a strip shape in the sub-scanning direction which is the direction of rotation of the conveyance belt 51. When the sheet 42 is fed on the thus alternately charged conveyance belt 51, the sheet 42 is attracted to the conveyance belt 51 and is conveyed in the sub-scanning direction by the rotational movement of the conveyance belt 51.

Then, the recording heads 34 are driven in response to image signals while moving the carriage 33 to discharge ink droplets onto the stopped sheet 42 to record a single line. After the sheet 42 is conveyed a predetermined distance, recording of a next line is performed. Upon reception of a recording end signal or a signal indicating that a rear end of the sheet 42 has reached the recording area, the recording operation is terminated and the sheet 42 is discharged to the sheet discharge tray 3.

Figure 3:
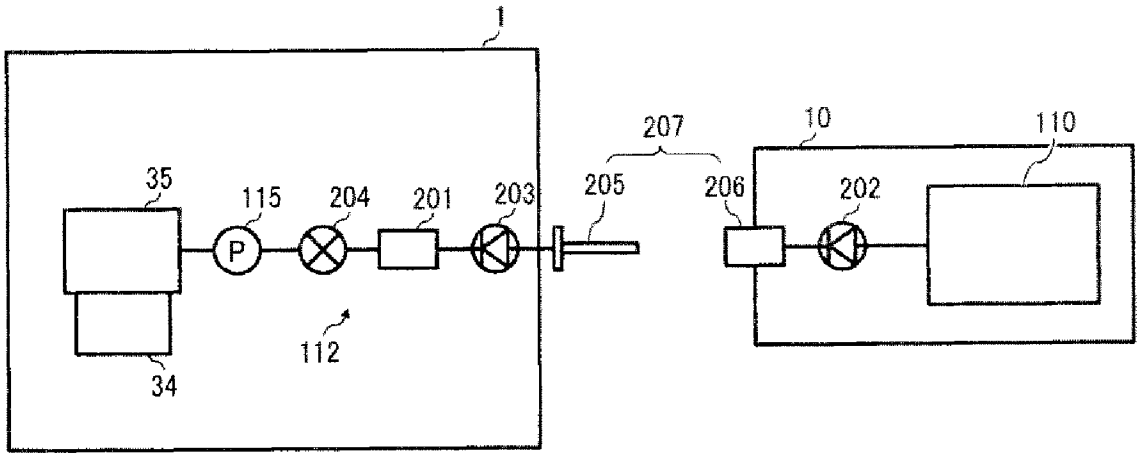
FIG. 3 is a schematic diagram illustrating a system of the image forming apparatus of an embodiment of the present invention.

Next, an ink supply system of the image forming apparatus according to an embodiment of the present invention will now be described with reference to FIG. 3. FIG. 3 is a schematic explanatory view showing the ink supply system of the present embodiment.

The recording heads 34 are integrally provided with the sub tank 35 as a liquid container, via a filter, not shown. The both are mounted on the carriage 33.

A main tank 10, a first liquid container, is provided with a rubber seal 206 as a first engagement means at a cartridge side. The rubber seal 206 may engage with a hollow needle 205 as a second engagement means for the side of the recording apparatus body 1. Thus, the ink or liquid supply path is communicated to an ink bag 110 provided inside the main tank 10 as a first liquid containing means or container and capable of being deformed by the outside pressure.

In the middle of the ink supply path, a first backflow prevention means 202 is provided allowing the liquid to flow in one direction of from the ink bag 110 toward the rubber seal 206, thereby preventing outside air or dusts from entering into the ink bag 110 through the rubber seal 206 even in a case where the ink cartridge 10 is not attached to the recording apparatus and the rubber seal 206 as an opening for the liquid inside the ink cartridge 10 is exposed to the outside air.

This ink bag 110 is communicated with the ink or liquid supply path 112 inside the apparatus body 1 via an engagement means 207 (formed of the hollow needle 205 and the rubber seal 206) when the main tank 10 is mounted to the apparatus body 1.

Also, in the middle of the ink supply path 112, a pump 115 is provided as a liquid moving means capable of applying pressure and suction. This pump 115 includes an elastic, deformable ink supply member, a pressure applying member and a rotation member. The ink supply member forming an ink supply path is herein an ink supply tube formed of an elastic, deformable material forming the ink supply path 112; the pressure applying member presses the ink supply tube; and the rotation member rotates the pressure applying member. The pressure applying member rotates while applying pressure to the ink supply tube forming the ink supply path 112, whereby the ink inside the ink supply path 112 is caused to be moved. Depending on the rotational direction of the rotation means, this pump 115 is capable of sending ink from the main tank 10 to the sub tank 35 via the ink supply path 112 and sending the ink reversely from the sub tank 35 via the ink supply path 112.

In the middle of the ink supply path 112, from the pump 115 toward the engagement means 207, a valve 204, a second liquid container 201, and a second backflow prevention unit 203 are sequentially provided.

Meanwhile, the ink supply path 112 provided in the apparatus body 1 may be formed of a flexible resinous tube sized by reference to the layout, ease of assembly, and ease of the maintenance. If negative pressure generation means is to be provided inside the sub tank 35, a flexible film may be used therefor.

Therefore, the apparatus body 1 of the present invention is configured such that the pump 115 once sucks ink from the recording heads 34 and the sub tank 35 based on a forecast amount of air bubble occurrence from detection results by an air bubble detection means, print number, out-of-use period, and the like, and refills them.

The recording heads 34 need to be kept at negative pressure so that the ink is not discharged from the nozzles which are not expected to be used. However, when the ink is filled to the recording heads 34, the recording heads 34 and the sub tank 35 need to be in a pressurized state. Therefore, after the ink is filled, the recording heads 34 and the sub tank 35 need to be negatively pressurized. The negatively pressurized state in the recording apparatus body 1 is gradually degraded over time due to the mixing-in of the air bubbles and the leak of air. If the negatively pressurized state is degraded below a specific value, generation of negative pressure needs to be performed again.

Then, when the apparatus body 1 detects the negative pressure of the sub tank 35 and determines it to be below the specific value, the pump 115 is caused to suck the ink from the sub tank 35 to have the sub tank 35 and the recording heads 34 negatively pressurized.

At that time, the ink sent from the recording heads 34 and the sub tank 35 by the pump 115 is stopped by the second backflow prevention unit 203 and is accumulated in the second liquid container 201. The second liquid container 201 serves as a buffer tank, is applied with pressure as the amount of ink increases, or may be arranged at a higher position than that of the ink bag 110 of the ink cartridge 10, whereby the pressure of the second liquid container 201 may be higher than that of the ink bag 110.

Then, when refilling the ink into the sub tank 35, the ink in the second liquid container 201 is sent out before that from the ink bag 110 of the ink cartridge 10. Accordingly, every time the ink is extracted from the recording heads 34 and the sub tank 35, the ink is not accumulated in the second liquid container 201. Therefore, the size of the second liquid container 201 is not large, resulting in an entire recording apparatus that is small enough.

When the recording apparatus body 1 detects that the ink bag 110 inside the ink cartridge 10 is empty from the count number of the prints and from the remaining amount detection means of the ink cartridge 10, it gives a warning to the user of the apparatus indicating the need to replace the ink cartridge 10. The user ejects the ink cartridge 10 from the apparatus in response to the warning, and the hollow needle 205 of the second engagement means at the side of the apparatus body 1 is exposed to the outside air.

If the ink cartridge 10 is pulled out from the apparatus in a state in which the ink is contained in the second liquid container 201, the hollow needle 205 of the second engagement means at the side of the apparatus body 1 is exposed to the outside air in a state in which the pressure of the second liquid container 201 is high. Even in this case, the second backflow prevention unit 203 provided in the ink supply path between the second liquid container 201 and the hollow needle 205 stops the ink from flowing from the second liquid container 201 toward the hollow needle 205, and thus, the ink will not leak from the hollow needle 205.

If in a state in which the liquid is contained in the second liquid container 201, the power to the recording apparatus body 1 is turned off and a considerably long time has elapsed, the liquid gradually flows via the pump 115, the liquid moving means, toward the second backflow prevention unit 203 and the recording heads 34 since the pressure in the second backflow prevention unit 203 and the recording heads 34 is lower than that of the second liquid container 201, and the negative pressure state of the second backflow prevention unit 203 and the recording heads 34 is degraded. Thus, there is a fear that the ink leaks from the nozzles of the recording heads 34.

Then, a valve 204 is provided between the sub tank 35 and the second liquid container 201. By closing the valve 204, the flowing of ink from the second liquid container 201 to the recording heads 34 and the sub tank 35 is prevented and the leaking of the ink from the recording heads 34 can be eliminated.

Further, by providing a normal close-type valve which becomes open only when the power is on for the valve 204, the communication in the path between the second liquid container 201 and the sub tank 35 can be closed securely even at a sudden power failure, whereby the flowing of ink from the second liquid container 201 to the recording heads 34 and the sub tank 35 is prevented and the leaking of the ink from the recording heads 34 eliminated.

Next, a second exemplary embodiment of the present invention will now be described with reference to FIG. 4. In the present embodiment, the second liquid container is not provided to the recording apparatus body 1 but to the ink supply path between the rubber seal 206 and the first backflow prevention means 202. The methods to eliminate air bubbles and to control the negative pressure formation are identical to those as described heretofore, and the description thereof will be omitted.

In the first embodiment as described referring to FIG. 3, the second backflow prevention unit 203 is arranged at a backside of the hollow needle 205 in the side of the recording apparatus body 1, thereby preventing ink from leaking from the hollow needle 205 when the ink cartridge 10 is ejected.

Figure 4:
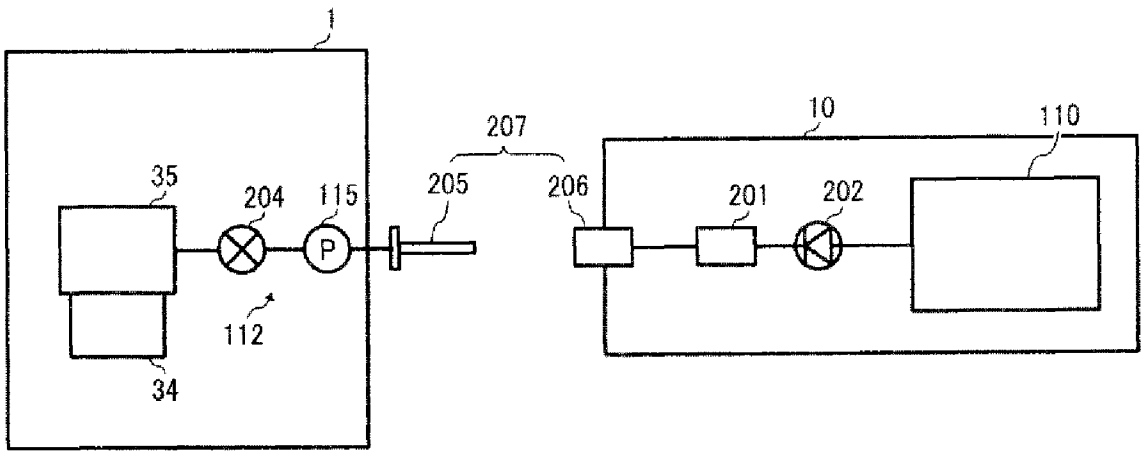
FIG. 4 is a schematic diagram illustrating a system of the image forming apparatus of a second embodiment of the present invention.

By contrast, in the second embodiment as illustrated in FIG. 4, even though the ink cartridge 10 is ejected in a state in which the ink is contained in the second liquid container 201 and thus the pressure thereof is high, the rubber seal 206 seals the hole where the needle has been pulled out and stops the ink from flowing out. Accordingly, the second embodiment can do without the second backflow prevention means provided in the first embodiment.

Figure 5:
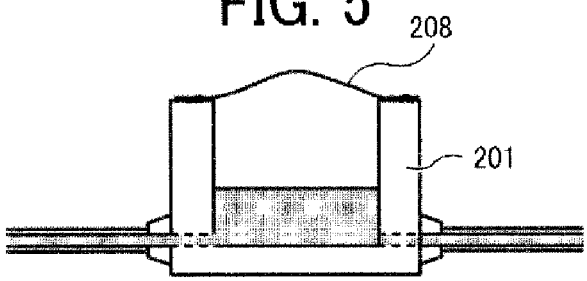
FIG. 5 is a schematic view illustrating a configuration of a liquid container of an embodiment of the present invention.
Figure 6:
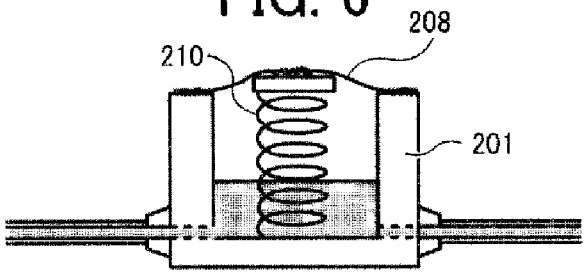
FIG. 6 is a schematic view illustrating a configuration of a liquid container of an embodiment of the present invention.

With reference to FIGS. 5, 6 and 7, the second liquid container will now be described. The second liquid container needs to increase pressure to the liquid when accommodating the liquid and sending it again to the sub tank 35 and the recording heads 34 prior to the first liquid container.

To cope with the above requirement, FIG. 5 shows an exemplary configuration of the second liquid container a part of which is formed as an opening and the opening is sealed by a flexible or elastic membrane 208, which may be fused to the container by adhesion or thermal fusion bonding.

In addition, if the pressure when accommodating the ink is not satisfactory with the use of the flexible or elastic membrane, a spring 210 as shown in FIG. 6 may be provided in order to press against the container inwardly.

Figure 7A:
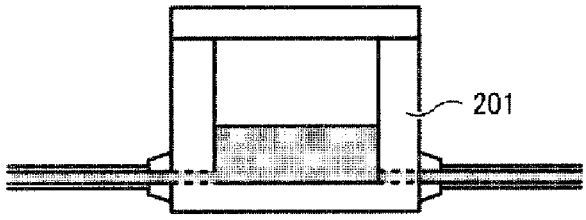
FIG. 7 is a schematic view illustrating a configuration of a liquid container of an embodiment of the present invention.
Figure 7B:
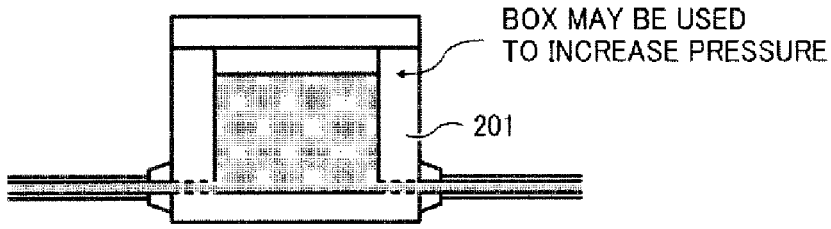

FIGS. 7(A) and 7(B) show cases in which the flexible or elastic membrane is not provided, but, if the air space may be secured satisfactorily, the pressure may be increased by the increasing air pressure inside the container as the accommodated liquid is increasing.

Figure 8A:
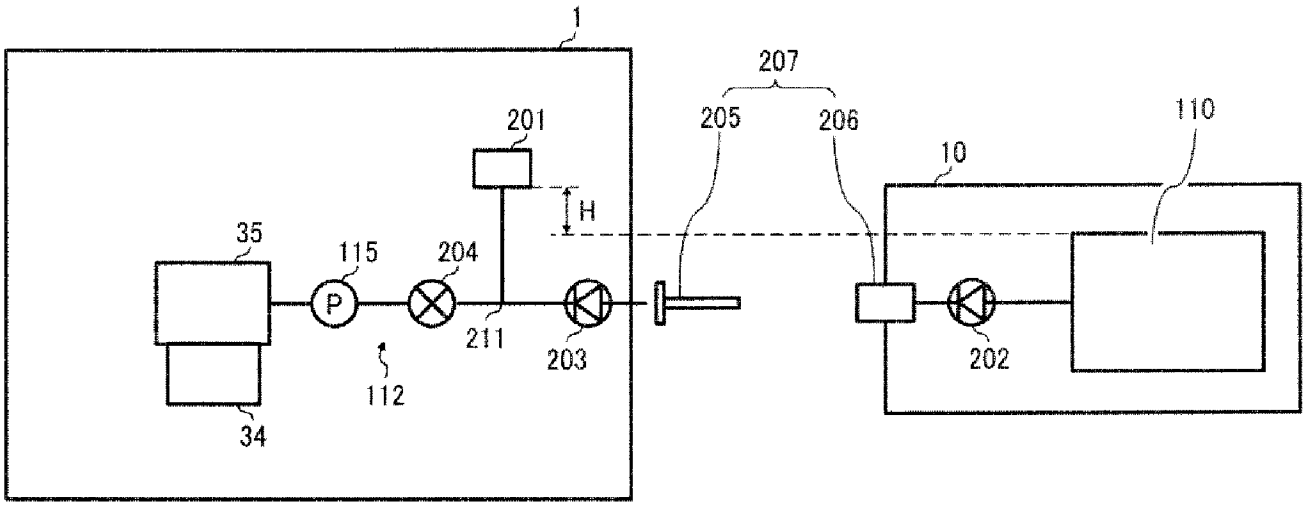
FIG. 8 is a schematic diagram illustrating a system of the image forming apparatus according to the present invention.
Figure 8B:
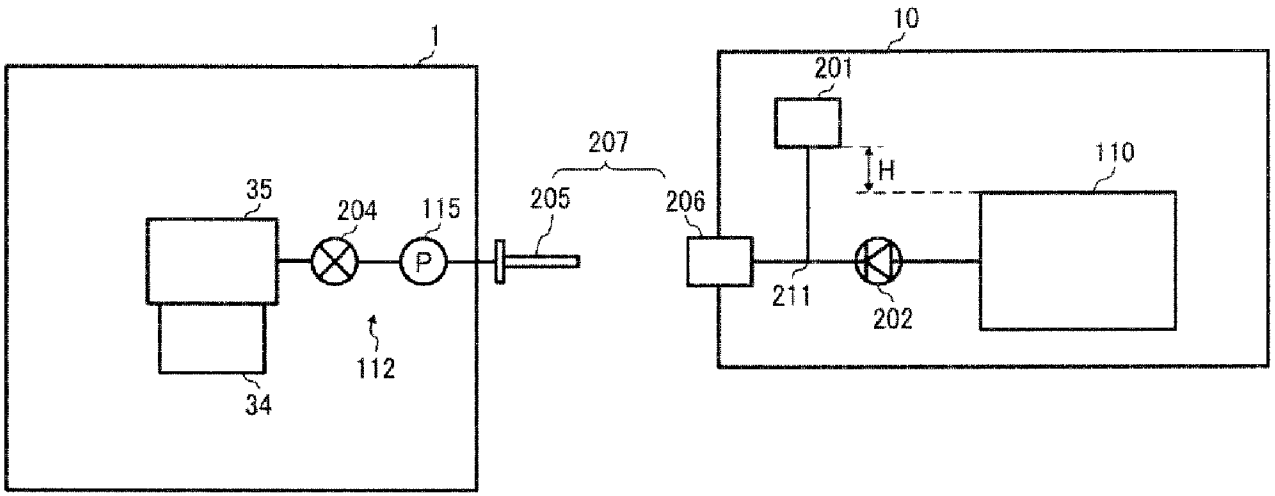

FIGS. 8(A) and 8(B) showcases in which the second liquid container is not provided in series in the ink supply path between the first liquid container and the sub tank, but is provided parallel thereto in a branched manner.

That is, when supplying liquid to the sub tank 35 from the second liquid container ahead of from the first liquid container the second liquid container may be arranged in series in the ink supply path from the first liquid container 10 to the sub tank 35.

By contrast, as illustrated in FIGS. 8(A) and 8(B), by setting the second liquid container 201 higher than the first liquid container 110 by a height difference H to have a higher water head pressure, more liquid may be sent from the second liquid container than from the first liquid container. Thus, the second liquid container 201 may be arranged in a branched manner.

Alternatively, by making the tube diameter of the branched second liquid supply path to be larger than that of the liquid supply path from the first liquid container to the sub tank, more liquid may be sent from the second liquid container than from the first liquid container so that the second liquid container may be formed in the branched manner.

Further alternatively, the second liquid container may employ a flexible membrane, an elastic membrane, a pressing member further added to those membranes, or the air pressure inside the container, whereby the pressure therein may be increased. Then, more liquid may be sent from the second liquid container in preference to the first liquid container and the second liquid container may be configured in the branched manner.

Thus, since the second liquid container is configured to be branched from the liquid supply path of from the first liquid container to the sub tank, the second liquid container may be freely provided in the recording apparatus, the circuit layout of the liquid supply path may be shortened, and the entire apparatus may be made compact.

Figure 9:
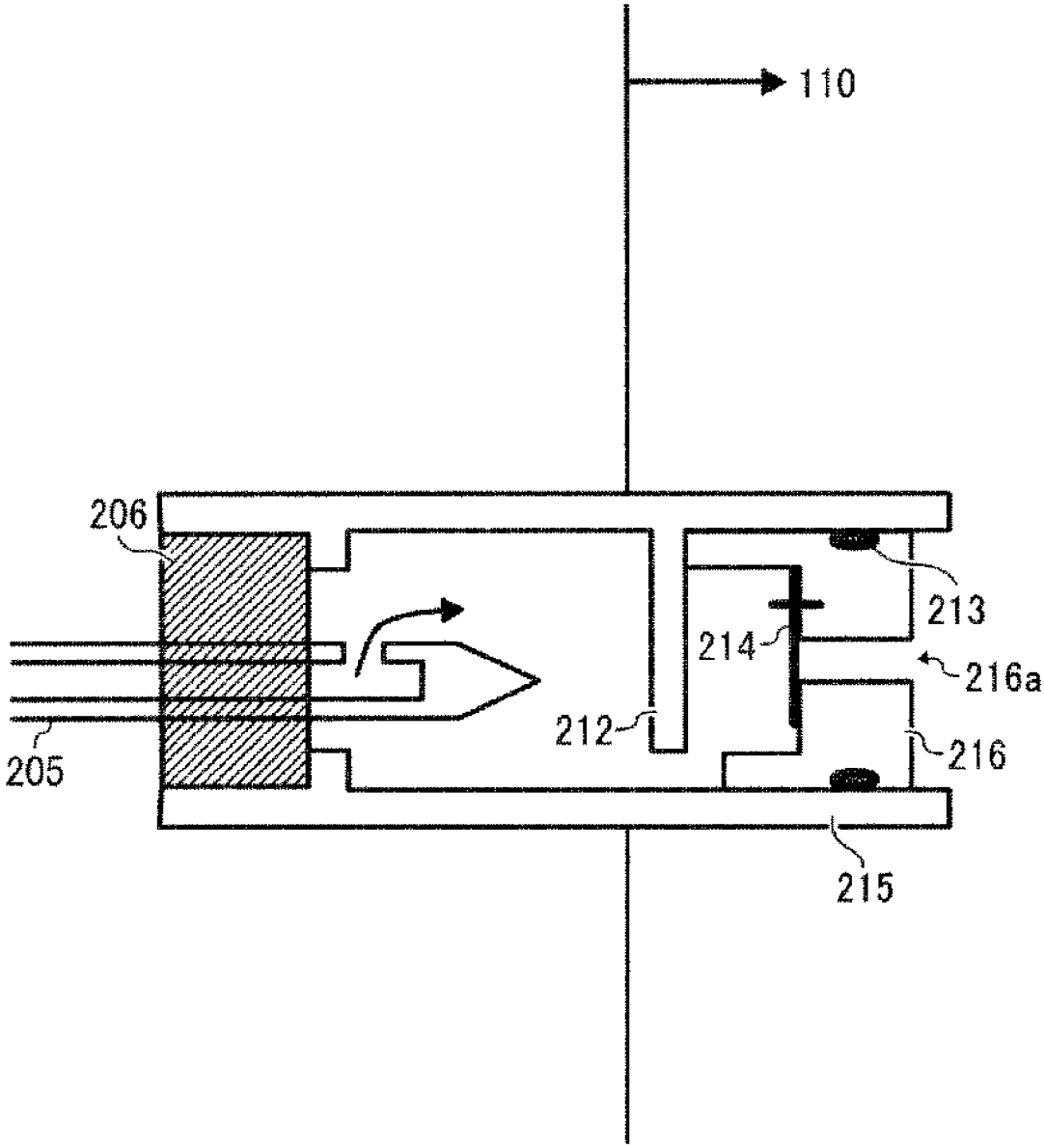
FIG. 9 is a schematic diagram illustrating a configuration of a backflow prevention unit according to the present invention.

With reference to FIG. 9, a configuration of a first backflow prevention means 202 will now be described. The first backflow prevention means 202 includes: a rubber seal 206 as an engagement means at the side of the ink cartridge; a backflow prevention valve 214 movable between an open position and a close position depending on the pressure; a backflow prevention part 216 to which the backflow prevention valve 214 is attached; a valve storage section 215 in which the backflow prevention valve 214 is stored; and a backflow prevention wall 212 to prevent damage to the backflow prevention valve 214 by the hollow needle 205.

The backflow prevention valve 214 is provided at a position to plug a hole 216*a* perforated in a side of the ink bag 110 of the backflow prevention part 216 mounted to the valve storage section 215, and is deformable by the pressure difference between the valve storage section 215 and the ink bag 110. When the ink is sucked from the hollow needle 205 inserted to the rubber seal 206, the pressure of the valve storage section 215 becomes less than that of the ink bag 110, whereby the backflow prevention valve 214 deforms toward the side of the valve storage section 215. Accordingly, the hole 216*a* which is open to the side of the ink bag 110 is not clogged by the backflow prevention valve 214, which allows the ink inside the ink bag 110 to flow through the valve storage section 215 toward the recording apparatus body.

In contrast, in a state where the hollow needle 206 is inserted or not inserted, when outside air or dust flows into the valve storage section 215 for any reason, the pressure of the valve storage section 215 increases up to above the pressure of the ink bag 110 and the backflow prevention valve 214 moves to the side of the ink bag 110, whereby the flow of the air into the ink bag 110 from the valve storage section 215 is shielded and the outside air and dust are prevented from entering.

The backflow prevention valve 214 may not prevent liquid from entering into the ink bag 110 completely unless the hole 216*a* of the valve storage section 215 at the side of the ink bag 110 is uniformly clogged. Accordingly, the backflow prevention valve 214 needs to have a particularly smooth surface. If its smooth surface is damaged by a contact of acute needle and the like, its ability to prevent entrance of outside air or dusts is drastically deteriorated. Then, the valve storage section 215 includes a prevention wall 212 provided at a position so as not to allow the hollow needle 201 inserted into the rubber seal 206 to trespass further backwards and damage the backflow prevention valve 24. Accordingly, when attaching or detaching the cartridge or while manipulating the cartridge, even though the hollow needle 206 trespasses erroneously or unexpectedly backwards, the prevention wall 212 receives the tip end of the hollow needle, thereby securely preventing damage to the backflow prevention valve 214.

A configuration of the first backflow prevention means will be described with reference to FIGS. 10(A) through 10(C). The first backflow prevention means includes: a rubber seal 206; a valve storage section 215; an O-ring 213; a backflow prevention part 216 with a hole 216*a* through which ink liquid flows to and fro; and a backflow prevention valve 214.

The valve storage section 215 and the backflow prevention part 216 are separately provided and used in combination, whereby these parts may be mass-produced at a low cost by projection molding. In addition, by using an O-ring 213 in an assembly of the valve storage section 215 and the backflow prevention part 216, the leak of the liquid may effectively be prevented even without using an adhesive agent.

These parts may be assembled using an adhesive, but the valve storage section 215 and the backflow prevention part 216 are the parts always immersed in ink, and therefore, insolubility in ink is important. Thus, the configuration without using the adhesive is preferred.

Figure 10B:
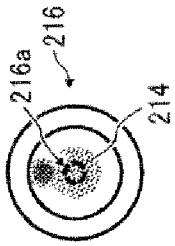
FIG. 10 is a schematic diagram illustrating a configuration of a backflow prevention unit according to the present invention.
Figure 10A:
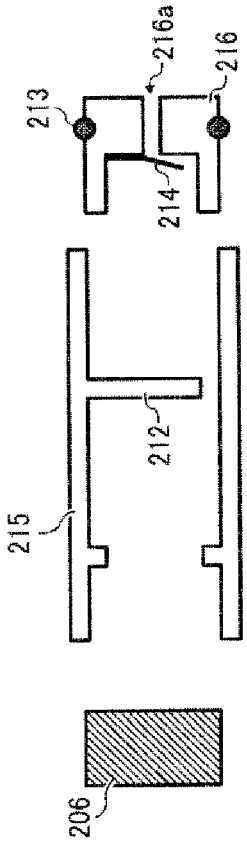
Figure 10C:
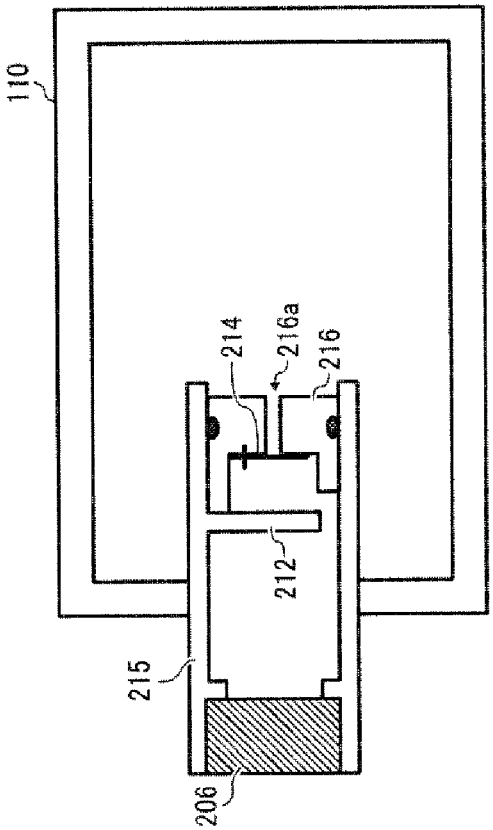

As illustrated in FIGS. 10(A) to 10(C), after the first backflow prevention means 202 is assembled, it can be connected or welded to be integrally formed with the ink bag 110 being the first liquid container 10, whereby a container capable of containing ink is provided.

Hereafter, a second embodiment of the present invention according to the present application will now be described with reference to FIGS. 11(A) and 11(B), in which the second liquid container is provided to the side of the ink cartridge 10.

Figure 11A:
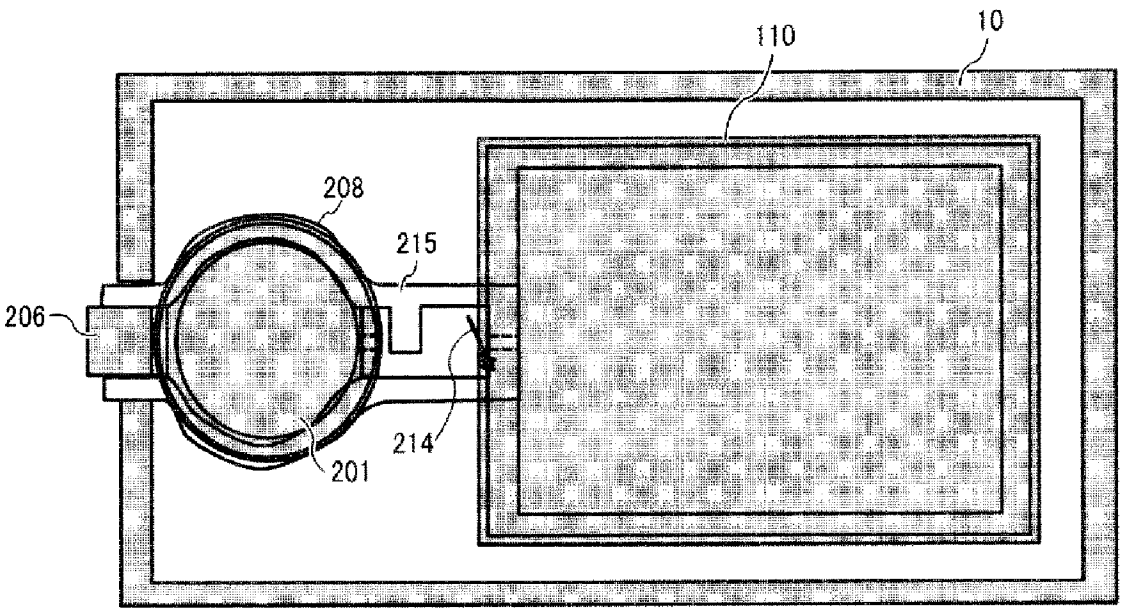
FIG. 11 is a schematic diagram illustrating a configuration of a cartridge of a second embodiment of the present invention.
Figure 11B:
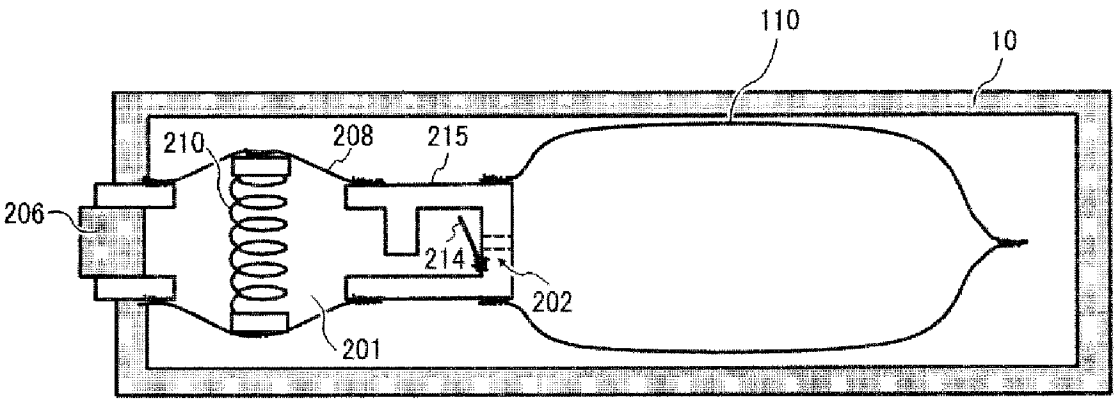

As illustrated in FIGS. 11(A) and 11(B), the ink cartridge 10 includes a rubber seal 206 as a cartridge side engagement means, a second liquid container 201 and a first backflow prevention means 202, which are integrally formed to the cartridge. As configured as above, the number of parts is reduced and an apparatus capable of forming a stable image at a low cost may be provided.

Figure 12A:
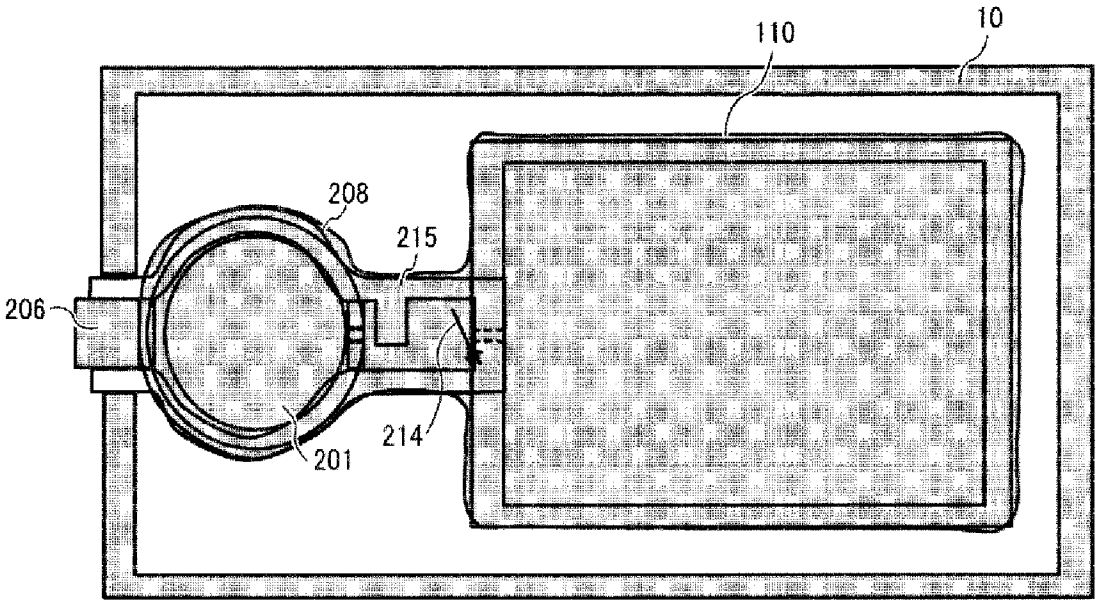
FIG. 12 is a schematic diagram illustrating a configuration of a cartridge of a second embodiment of the present invention.
Figure 12B:
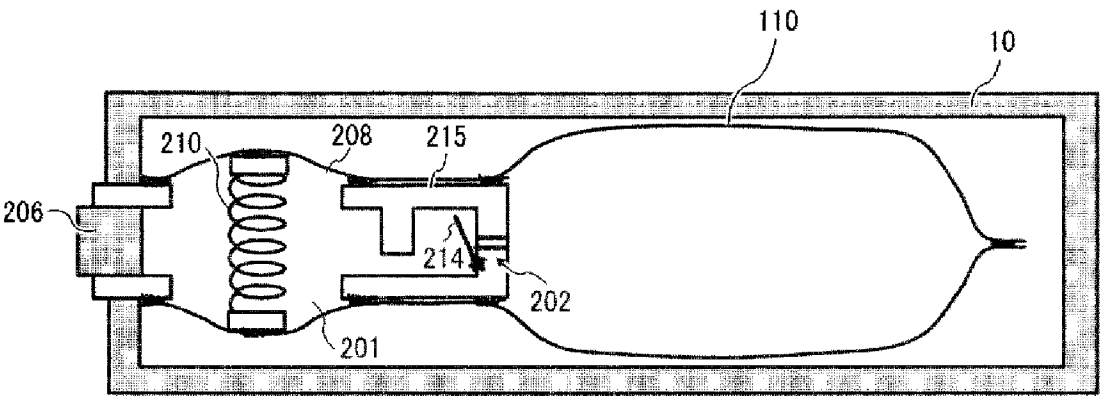

With reference to FIGS. 12(A) and 12(B), a second exemplary configuration of the cartridge in which the second liquid container is provided to the side of the ink cartridge 10 will be described.

In the configuration of FIG. 11, the flexible or elastic membrane of the second liquid container 201 is disposed to the second liquid container 201 as a member separate from the ink bag 110.

By contrast, in the configuration of FIG. 12, the flexible membrane of the second liquid container 201 is formed of an extended member of the flexible membrane forming an ink bag 110. As configured as above, the number of parts is reduced and an apparatus capable of forming a stable image may be provided at a low cost.

Figure 13A:
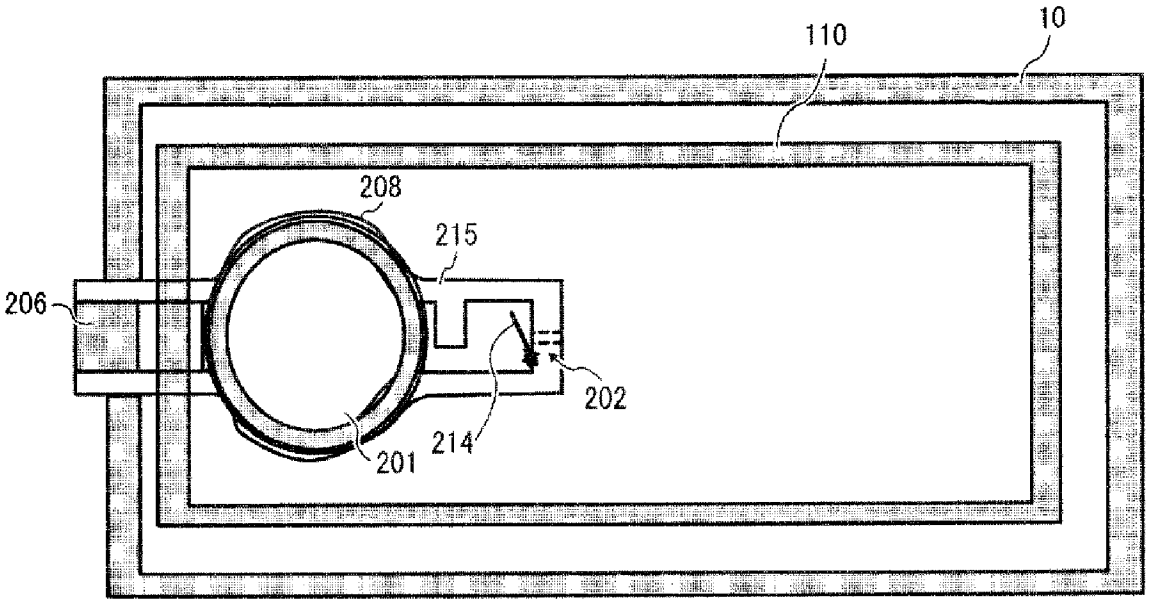
FIG. 13 is a schematic diagram illustrating a configuration of a cartridge of a second embodiment of the present invention.
Figure 13B:
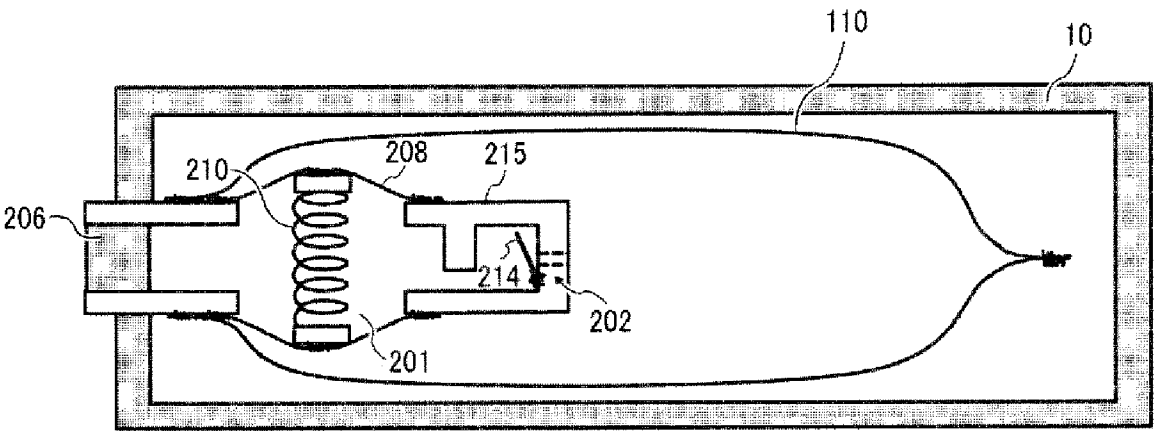

In addition, with reference to FIGS. 13(A) and 13(B), a third exemplary configuration of the cartridge in which the second liquid container 201 is provided to the side of the ink cartridge 110 according to the second embodiment of the present invention will be described.

In the configuration of FIG. 13, the second liquid container 201 is formed inside the ink bag 110. As configured as such, even though the ink is leaked from the second liquid container 201, the leaked ink stays inside the ink bag 110. Therefore, the outside of the ink cartridge is not contaminated and a high reliability is preserved.

In examples as illustrated in FIGS. 11 through 13, examples employing the flexible or elastic membrane 208 and further the biasing means 210 are shown. However, the biasing means 210 may be omitted if the pressure of the second liquid container 201 is satisfactorily increased by the flexible or elastic membrane 208.

Additional modifications and variations of the present invention are possible in light of the above teachings. It is therefore to be understood that within the scope of the appended claims the invention may be practiced other than as specifically described herein.

What is claimed is:

1. An image forming apparatus to form an image by discharging droplets, comprising:

a recording head to discharge liquid droplets;

an ink cartridge comprising a first liquid container and a first engagement unit located at a side of the ink cartridge, the first liquid container attachable to and detachable from the image forming apparatus via the first engagement unit;

a first backflow prevention unit, arranged between the first engagement unit and the first liquid container, to prevent a backflow of ink into the first liquid container;

a sub tank configured to temporarily hold ink supplied thereto from the first liquid container via a liquid supply path and to supply the held ink to the recording head;

a liquid moving unit, provided in the liquid supply path between a second engagement unit located at the side of the image forming apparatus and the sub tank, to supply ink inside the first liquid container to the sub tank as well as return ink from the sub tank toward the second engagement unit at the side of the image forming apparatus;

a second liquid container, provided in the liquid supply path between the liquid moving unit and the second engagement unit at the side of the image forming apparatus, to accommodate ink returned by the liquid moving unit from the sub tank toward the second engagement unit at the side of the image forming apparatus; and a second backflow prevention unit to prevent a backflow of the ink, provided between the second liquid container and the second engagement unit at the side of the image forming apparatus.

2. The image forming apparatus as claimed in claim 1, wherein, when the liquid moving unit sends liquid to the sub tank, the liquid is sent from the second liquid container before the first liquid container.

3. The image forming apparatus as claimed in claim 1, wherein the second liquid container has an opening sealed by a flexible or elastic membrane.

4. The image forming apparatus as claimed in claim 3, further comprising a biasing member to press the flexible or elastic membrane inward.

5. The image forming apparatus as claimed in claim 1, wherein a valve is provided in the liquid supply path between the sub tank and the second liquid container.

6. The image forming apparatus as claimed in claim 1, wherein the valve is normally closed.

7. The image forming apparatus as claimed in claim 1, wherein the second liquid container is provided at a position having a higher water head pressure than the first liquid container.

8. The image forming apparatus as claimed in claim 1, further comprising a first backflow prevention unit provided in a liquid supply path extending from a liquid inlet to the first liquid container, the first backflow prevention unit comprising:

a backflow prevention valve movable between an open position and a closed position, the open position opening the liquid supply path and allow a liquid to flow from the first liquid containing unit to the second engagement unit at the side of the recording apparatus connected to the first engagement unit at the side of the ink cartridge and the closed position plugging the liquid supply path to prevent outside air or dust from entering getting into the first liquid containing unit from the first engagement unit at the side of the ink cartridge;

a valve storage section to store the backflow prevention valve; and a backflow prevention wall to prevent the second engagement unit at the side of the recording apparatus from contacting the backflow prevention valve.

9. The image forming apparatus as claimed in claim 1, wherein the first engagement unit at the side of the cartridge is a rubber seal and the second engagement unit at the side of the recording apparatus body is a hollow needle.

10. An image forming apparatus, comprising:

a recording head to discharge liquid droplets;

an ink cartridge comprising a first liquid container and a first engagement unit located at a side of the ink cartridge, the first liquid container attachable to and detachable from the image forming apparatus body via the first engagement unit;

a first backflow prevention unit, arranged in a liquid supply path between the first engagement unit and the first liquid container, to prevent a backflow of ink into the first liquid container;

a second liquid container to temporarily hold a backflow from the recording head in a liquid supply path between the first engagement unit at the side of the ink cartridge and the first backflow prevention unit;

a sub tank configured to temporarily hold a liquid supplied via the liquid supply path from the first liquid container and supply this liquid to the recording head; and a liquid moving unit provided in the liquid supply path between a second engagement unit at the side of the image forming apparatus and the sub tank and capable of sending the liquid to and returning the liquid from the sub tank.

11. The image forming apparatus as claimed in claim 10, wherein, when the liquid moving unit sends liquid to the sub tank, the liquid is sent from the second liquid container before the first liquid container.

12. The image forming apparatus as claimed in claim 10, wherein the second liquid container has an opening sealed by a flexible or elastic membrane.

13. The image forming apparatus as claimed in claim 12, further comprising a biasing member to press the flexible or elastic membrane inward.

14. The image forming apparatus as claimed in claim 10, wherein a valve is provided in the liquid supply path between the sub tank and the second liquid container.

15. The image forming apparatus as claimed in claim 10, wherein the valve is normally closed.

16. The image forming apparatus as claimed in claim 10, wherein the second liquid container is provided at a position having a higher water head pressure than the first liquid container.

17. The image forming apparatus as claimed in claim 10, further comprising a first backflow prevention unit provided in a liquid supply path extending from a liquid inlet to the first liquid container, the first backflow prevention unit comprising:

a backflow prevention valve movable between an open position and a closed position, the open position opening the liquid supply path and allow a liquid to flow from the first liquid containing unit to the second engagement unit at the side of the recording apparatus connected to the first engagement unit at the side of the ink cartridge and the closed position plugging the liquid supply path to prevent outside air or dust from entering getting into the first liquid containing unit from the first engagement unit at the side of the ink cartridge;

a valve storage section to store the backflow prevention valve; and a backflow prevention wall to prevent the second engagement unit at the side of the recording apparatus from contacting the backflow prevention valve.

18. The image forming apparatus as claimed in claim 10, wherein the first engagement unit at the side of the cartridge is a rubber seal and the second engagement unit at the side of the recording apparatus body is a hollow needle.

* * * * *